US007363737B2

(12) United States Patent
Benalikhoudja

(10) Patent No.: US 7,363,737 B2
(45) Date of Patent: Apr. 29, 2008

(54) ADVERTISING DISPLAY WITH THE DIFFUSION OF SCENTS

(75) Inventor: Karim Benalikhoudja, Mauguio (FR)

(73) Assignee: Prolitec, Inc., Milwaukee, WI (US)

( * ) Notice: Subject to any disclaimer, the term of this patent is extended or adjusted under 35 U.S.C. 154(b) by 0 days.

(21) Appl. No.: 10/551,291

(22) PCT Filed: Mar. 29, 2004

(86) PCT No.: PCT/EP2004/050390

§ 371 (c)(1),
(2), (4) Date: May 26, 2006

(87) PCT Pub. No.: WO2004/086336

PCT Pub. Date: Oct. 7, 2004

(65) Prior Publication Data

US 2006/0236570 A1 Oct. 26, 2006

(30) Foreign Application Priority Data

Mar. 28, 2003 (FR) ..... 03 04117

(51) Int. Cl.
*G09F 19/00* (2006.01)

(52) U.S. Cl. ..... 40/407; 40/725

(58) Field of Classification Search ..... 40/407; 239/8, 340, 346

See application file for complete search history.

(56) References Cited

U.S. PATENT DOCUMENTS 1,204,934 A * 11/1916 Burford et al. ..... 40/407
3,844,057 A * 10/1974 Johnson ..... 40/407
4,208,098 A * 6/1980 Johnson ..... 359/467
5,398,070 A * 3/1995 Lee ..... 348/553
5,549,247 A * 8/1996 Rossman et al. ..... 239/57
5,826,357 A 10/1998 Hechler
6,536,910 B2 * 3/2003 Lin ..... 362/96
2002/0008152 A1 1/2002 Yahav
2002/0175188 A1 11/2002 Holyfield
2004/0194357 A1 * 10/2004 d'Ornano ..... 40/124.02

FOREIGN PATENT DOCUMENTS

FR 2 682 794 A 4/1993
JP 2000 267611 A 9/2000
WO WO 96/03218 A 2/1996

* cited by examiner

*Primary Examiner*—Lesley D. Morris
*Assistant Examiner*—Christopher E Veraa
(74) *Attorney, Agent, or Firm*—Godfrey & Kahn, S.C.; Alan R. Stewart

(57) ABSTRACT

The advertising panel is to display an advertising message and to diffuse a scent which is associated with the contents of the visually-displayed message. The inventive panel includes a parallelepiped volume containing: an assembly which is used to display an advertising message that is disposed opposite a display window, and at least one scent diffuser which is connected to a scent-diffusing element which is in turn installed opposite an opening in the panel, such as to diffuse a scented flow to the exterior. The diffusing element is connected to the head of the scent diffuser, thereby ensuring that a carrier gas is mixed with the scented fluid contained in the receptacle. The scented flow obtained at the outlet of the head is pulsed towards the diffusing element and, subsequently, to the exterior of the panel.

25 Claims, 7 Drawing Sheets

ADVERTISING DISPLAY WITH THE DIFFUSION OF SCENTS

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

It is to be specified that in this description, odor diffuser is understood as any material means capable of producing, diffusing or releasing an odoriferous substance.

The subject of this invention is a billboard that diffuses odors, designed to be seen simultaneously by several people, the nature of the fragrance diffused being for example in close relation with the content of the advertising message displayed so that the two visual and olfactory messages mutually reinforce each other's effects to significantly improve the perception of the advertising message by the public.

BACKGROUND OF THE INVENTION

Thus, the subject of thus invention is a billboard designed to display an advertising message intended to be seen simultaneously by several people and the diffusion of an odor, the nature of which is for example in relation with the content of the visual message displayed, said billboard comprising a frame 2 constituted by the assembling of two vertical posts 3 to two upper and lower horizontal cross-pieces 4, said board defining a parallelepiped volume in which at least one of the two large opposite vertical faces comprises a display quadrangular window, bounded by a perimeter marginal zone of the billboard face and in whose volume an advertising message display assembly is arranged facing the window 7, is mainly characterized by an odor diffuser capable of generating an odoriferous stream, installed in the internal volume of the board, said odor diffuser being associated to an odor diffusing element, which element comprises a diffusion chamber receiving the odoriferous stream, said chamber being in a communication relation with an opening in the board, ending outside the latter to diffuse the odoriferous steam generated by the diffuser outside of the internal volume of said board.

As understood, the purpose of the odor diffuser is to produce an odoriferous stream at a predefined rate and the purpose of the diffusing element is to diffuse said odoriferous stream into the atmosphere exterior to the board.

The odor diffuser and the diffusing element by being completely inside the billboard are fully protected by the latter and secure from any act of vandalism.

The diffusion of an odor in the immediate environment of a billboard, placed for example outside, in pedestrian walkways and other public places, supposes that the flow rate of the diffused odoriferous stream is high enough for the odor to be easily noticeable within a very short time after its diffusion into the atmosphere.

To that effect, the diffusing element consists of a body comprising a diffusion chamber receiving the odoriferous stream, having a first opening facing the billboard opening to the outside, a second opening facing the internal volume of the board, in which second opening a fan is placed to drive an air flow from the internal volume of the board to said chamber so that this air flow mixes with the odoriferous stream contained in the chamber and that the mixture achieved is drawn to the outside of the panel.

The odor diffuser can consist of a substrate impregnated with a volatile odoriferous product that can come in the form of a gel or liquid. The odor diffuser can also be a container containing odoriferous products that can come in the form of crystals, a gel, liquid or else.

Such an odor diffuser can be placed in the diffusing element outlet chamber.

BRIEF SUMMARY OF THE INVENTION

Under a preferred embodiment, the odor diffuser has a head providing for the mixing of a carrier gas with an odoriferous fluid contained in a suitable container, said head being in communication relation with the diffusion chamber and having an outlet through which the odoriferous stream obtained is delivered, which is driven toward the diffusing element, to be then driven to the outside of the board. In this figure case, the odor diffuser is placed outside the diffusing element outlet chamber and said diffusing element comprises an odoriferous stream inlet in said chamber, connected through a line at the outlet of the odor diffuser head.

The mixing of the odoriferous stream delivered by the mixing head and the air flow drawn by the fan thus takes place in the outlet chamber. The mixture produced discharges from the chamber through the first opening and then through the board opening. Because of the air flow drawn by the fan, this diffusing element increases the speed of diffusion of the produced odoriferous mixture into the immediate environment. To compensate for the effects of dilution of the odoriferous mixture produced by the mixing head in the outlet chamber, the proportion of odoriferous fluid in this mixture will be increased and the head will be adjusted accordingly.

The use of a diffusing element makes it possible to use a low diffusion rate and thus low power usage diffuser. Such diffusers generally are small-sized which is conducive to facilitating their integration into the internal volume of the board.

According to another characteristic of the invention, the odoriferous fluid is an odoriferous gas, the odor diffuser comprising then an odoriferous compressed gas container, connected through a manifold to the mixing head.

But preferably, according to another characteristic of the invention, the odoriferous fluid is a liquid, the odor diffuser comprising then an odoriferous liquid container connected to the mixing head, said head also ensuring the fractioning of the liquid into fine particles.

In this latter embodiment, if there is no need for a significant flow rate at the outlet of the board, the diffusing element will not have a fan and will thus consist of a body comprising a tight diffusion chamber receiving the odoriferous stream of the odor diffuser, this chamber having an outlet opening in communication relation with the board opening and an odoriferous stream inlet in communication relation with said diffuser. This diffusion chamber will act as relief chamber so that the large particles that the odoriferous stream might carry settle on the latter's wall.

According to another characteristic of the invention, the odor diffuser mixing head comprises a head body in which a mixing chamber, a first conduit in communication relation with the mixing chamber and with the internal volume of the odoriferous fluid container, a second conduit in communication relation with the mixing chamber and with a form of socket end, made horizontally in said head and terminating on the lateral face of the head body, said second conduit being designed to receive a stream of compressed carrier gas and a third conduit in communication relation on one hand in the mixing chamber and on the other hand with an outlet port made in the upper face of the head body, said third conduit and said outlet port being designed to lead the carrier gas and odoriferous fluid mixture to the outside of the head.

According to another characteristic of the invention, the odoriferous fluid container and the mixing head are mounted in a removable manner in a fixed support in one of the posts of the board frame.

According to another characteristic of the invention, the support has a horizontal spigot end designed to fit into the socket end of the mixing head, said spigot end being connected through a line at the compressor compressed air outlet on the odor diffuser.

According to another characteristic of the invention, the support bears a vertical fitting end connecting the outlet port to the mixing head, said fitting end being connected to the diffusing element through a pipe.

These characteristics facilitate the removal or installation in the support of the assembly made of the container and the mixing head.

According to another characteristic of the invention, the odor diffuser is divided into two separate modules.

BRIEF DESCRIPTION OF THE SEVERAL VIEWS OF THE DRAWINGS

Other advantages and characteristics of the invention will become apparent when reading the description of a preferred embodiment, given as a non limiting example, with reference to the attached drawings.

DETAILED DESCRIPTION OF THE INVENTION

Figures 1, 1A:
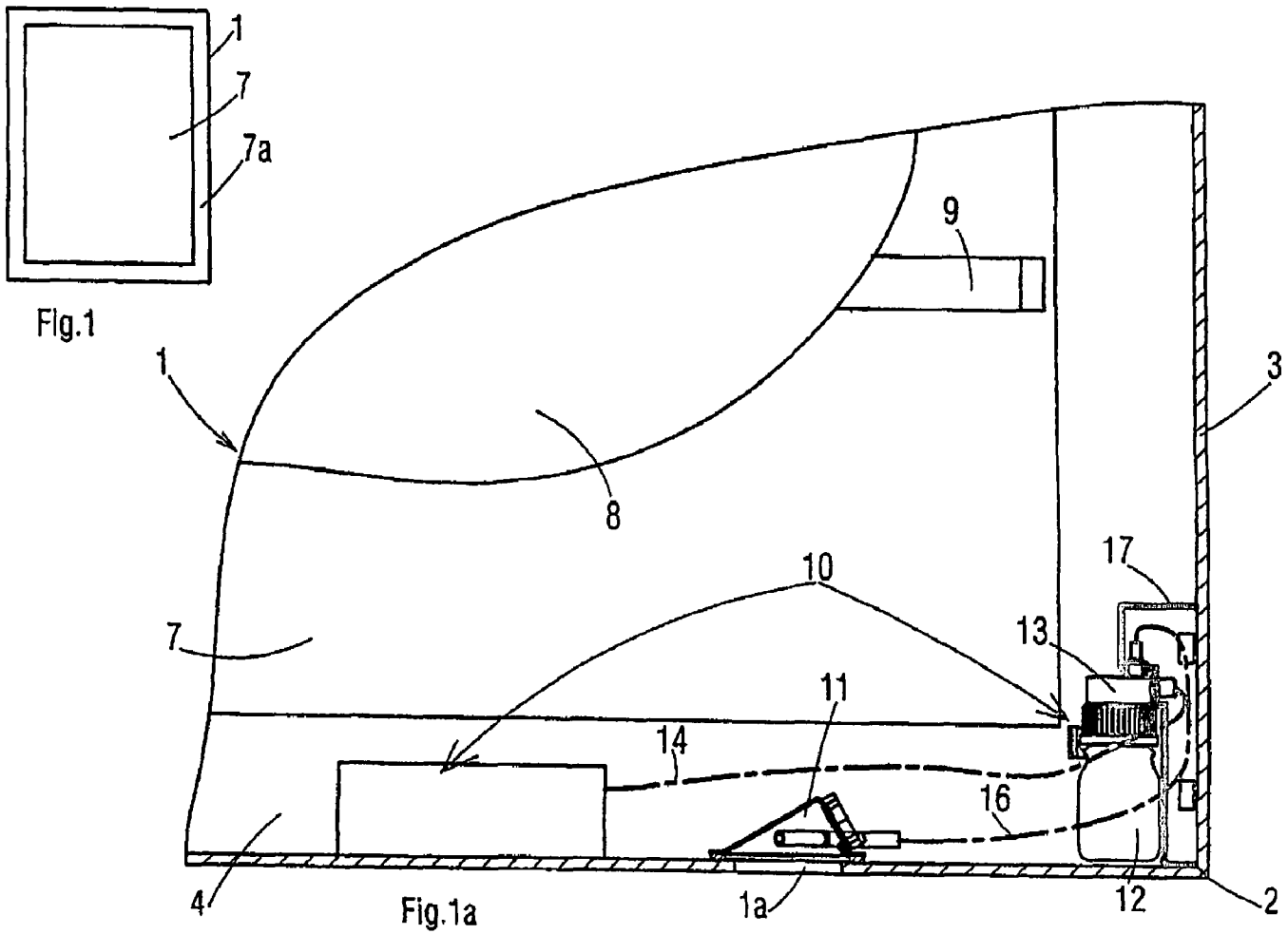
FIG. 1 is a front elevation view of a billboard under the invention.
FIG. 1*a* is a partial sectional view of a board under the invention.
Figure 2:
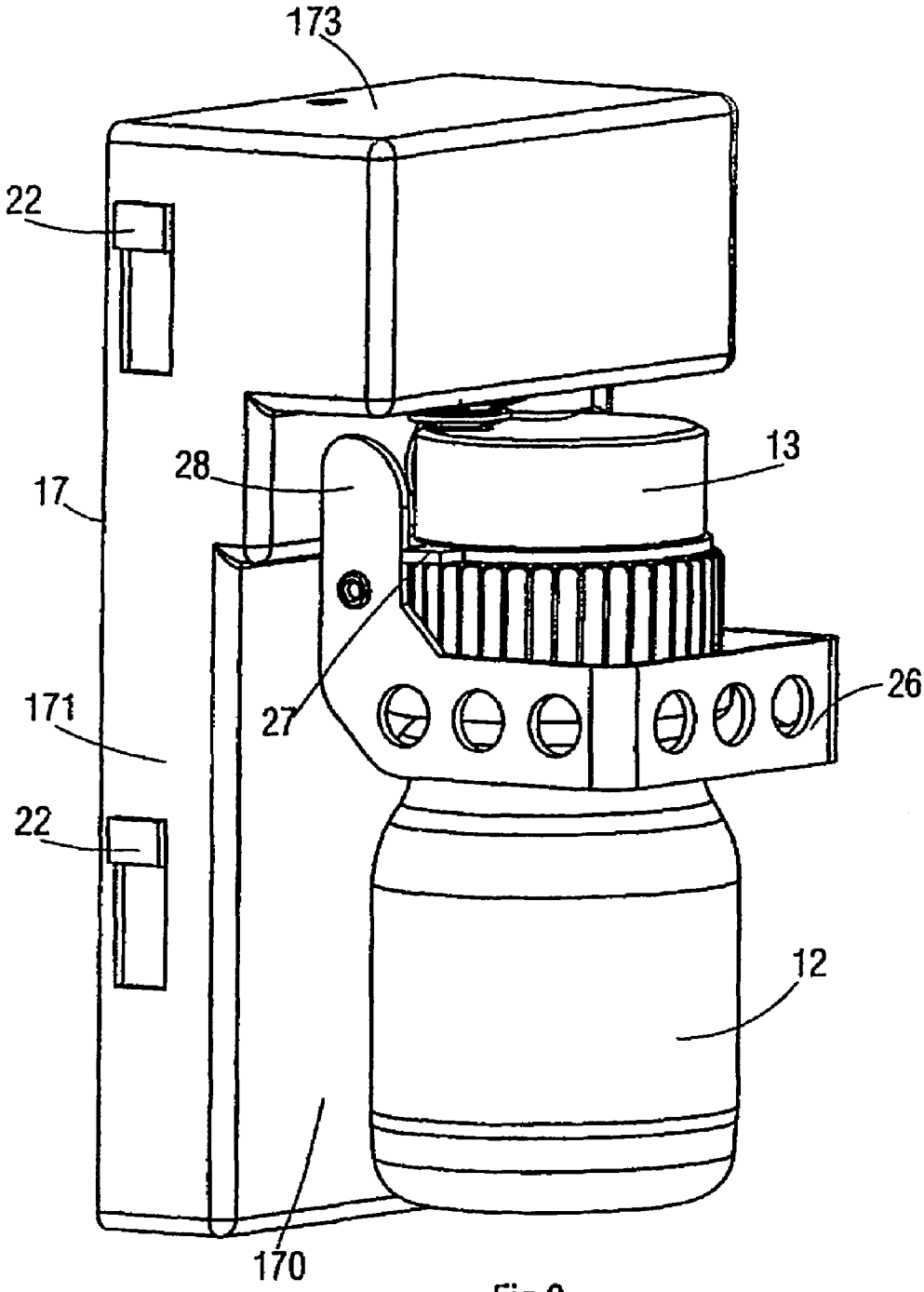
FIG. 2 is a perspective view of the head and container assembly in its support.
Figure 3:
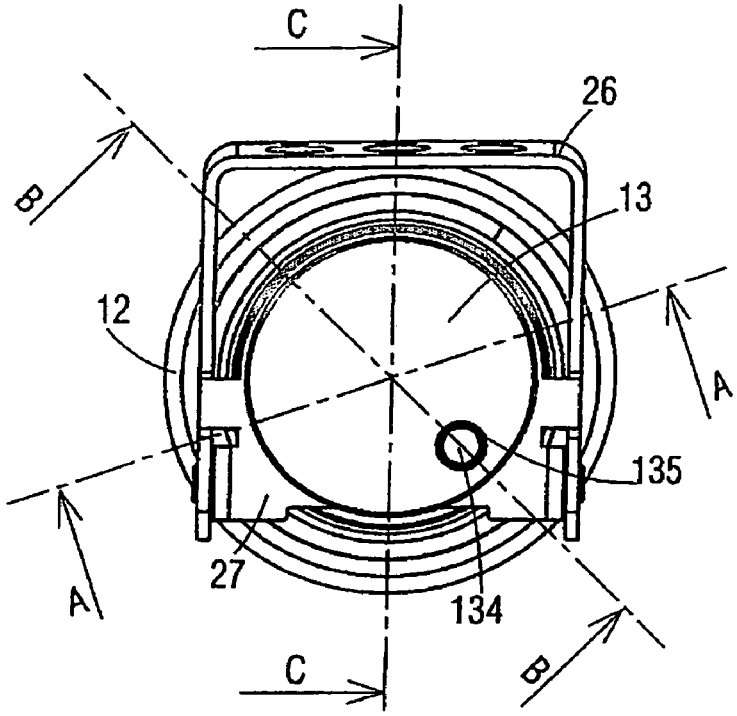
FIG. 3 is a top plan view of the odor diffuser head.
Figure 4:
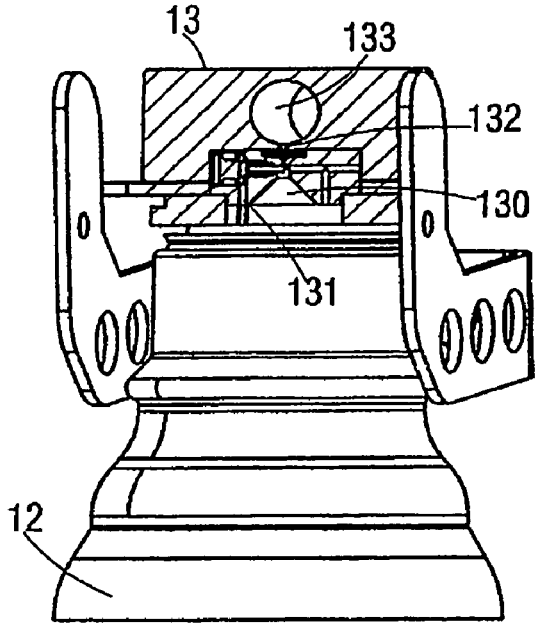
FIG. 4 is a cross-sectional view along line A-A of FIG. 3.
Figure 4A:
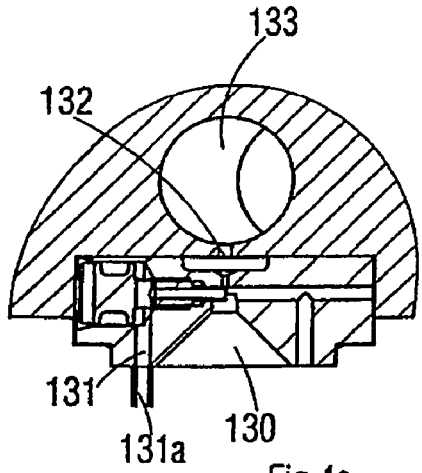
FIG. 4*a* is an enlarged sectional view of the head shown in FIG. 4.
Figure 5:
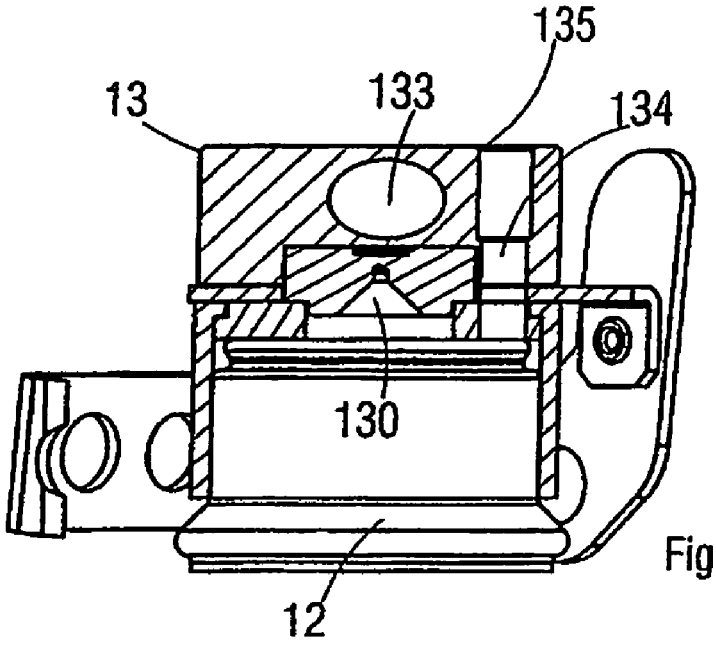
FIG. 5 is a cross-sectional view along line B-B of FIG. 3.
Figure 6:
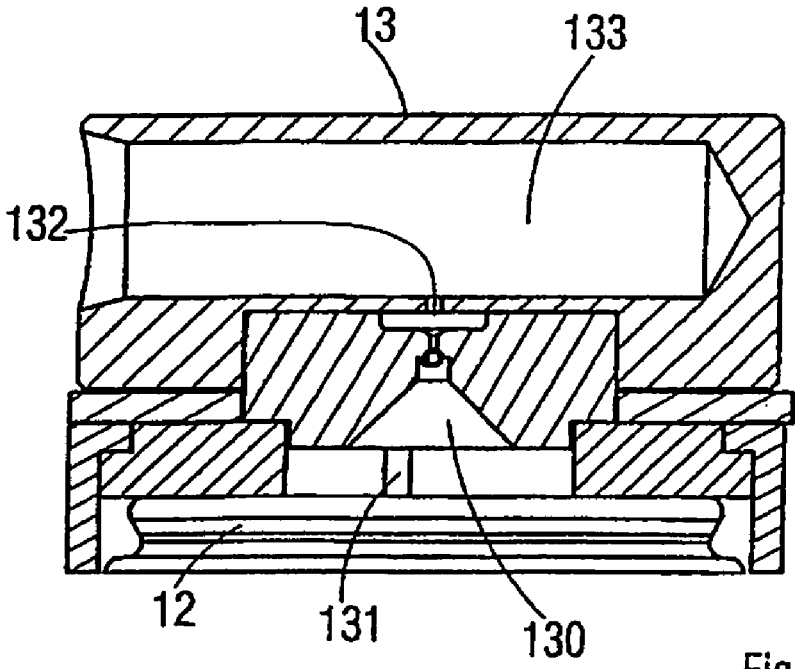
FIG. 6 is a cross-sectional view along line C-C of FIG. 3.
Figure 7:
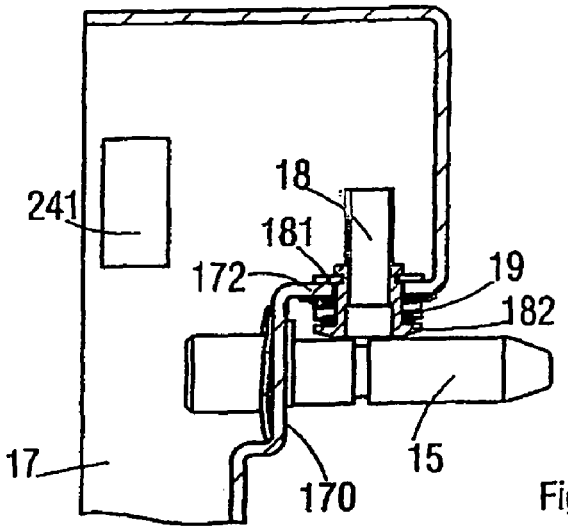
FIGS. 7 and 8 are detailed sectional views of the support for the odor diffuser head and container assembly.
Figure 8:
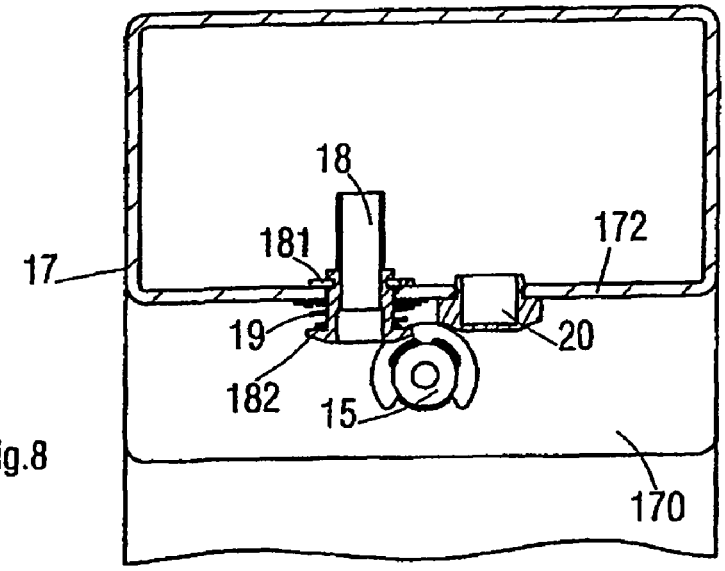
Figure 9:
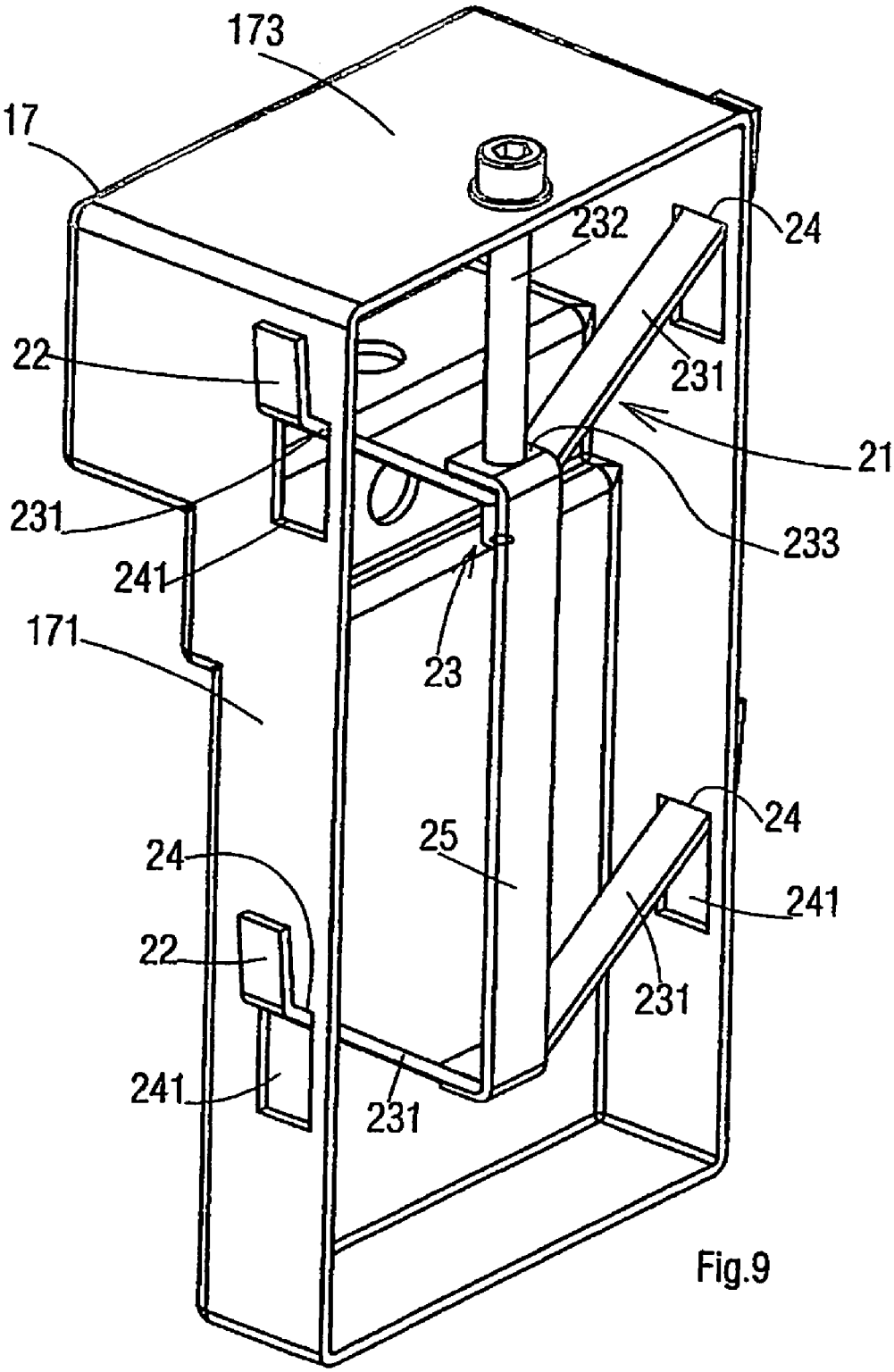
FIG. 9 is an inner perspective view of the fastening mechanism associated with the support for the container/head assembly.
Figure 10:
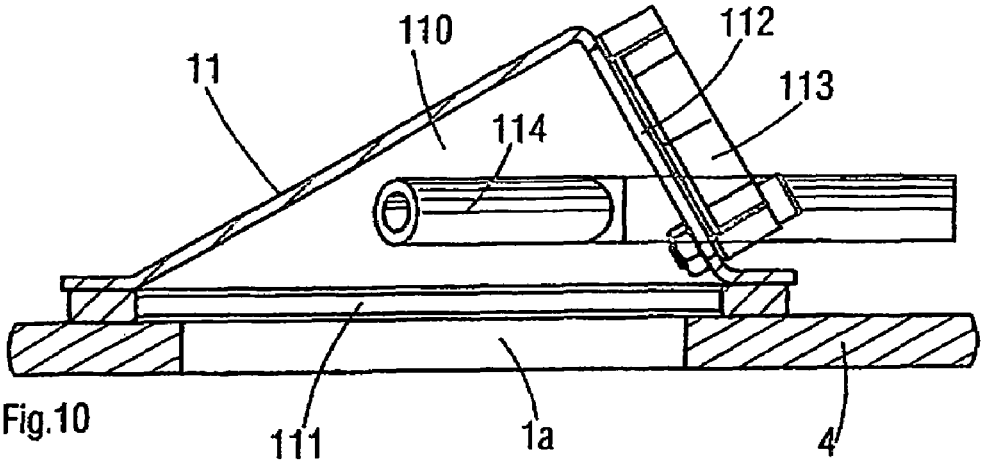
FIG. 10 is a cross-sectional view of the diffusing element.
Figure 11:
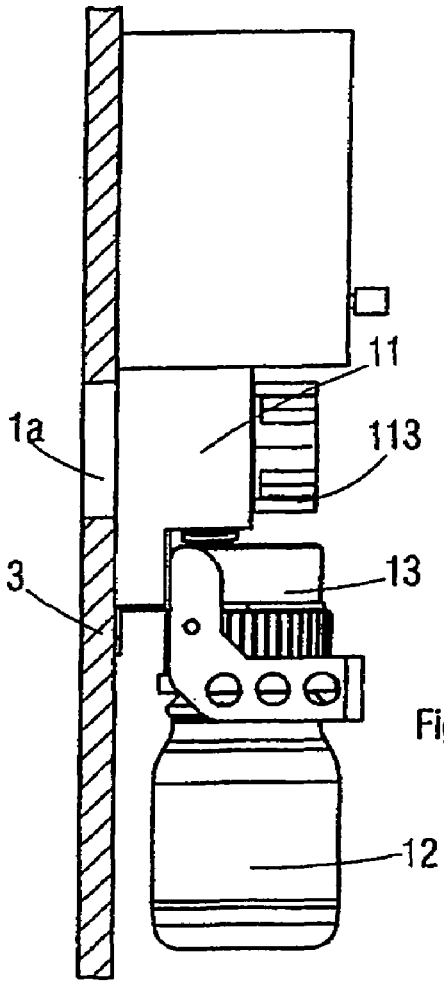
FIG. 11 is a side elevation view of an odor diffuser under another embodiment, with both modules placed side by side.

As shown, the billboard 1 under the invention is designed to display an advertising message and to diffuse an odor, the nature of which is related to the content of the displayed advertising message. Thus for a food product, the visual advertising message can be supplemented with an olfactory message that is a reminder of that product.

Typically, the billboard 1 comprises a frame 2 making up its support structure, formed by the assembling of two vertical posts 2 with two upper and lower horizontal crosspieces 3. The board 1 defines a parallelepiped volume of relatively small thickness compared to its other dimensions (height and width) with at least one of the two large opposite vertical faces occupied by a quadrangular display window 7, bounded by a perimeter marginal area 7*a* of said large face of the board. The face of the board comprising window 7 can consist of a transparent quadrangular wall of height and width dimensions identical to those of the board.

This wall will make up the window 7, the marginal zone 7*a* will for example be made of vertical and horizontal bands making up a screen and bounding the vertical and horizontal sides of said wall. The window 7, as it is understood, is delineated by the screen bands. This wall will be attached to the board frame through any known means.

The other large face of the board will be made of a rectangular opaque wall attached in a known manner to the board frame.

A display device designed to feature a removable advertising bill 8 facing the window 7 is mounted inside the board parallelepiped volume. In addition, the display device is provided with a set of lighted tubes 9 capable of diffusing a white light in the volume defined by the frame. This lighting device provides for the back-lighting of the advertising bill 8.

The display device can be of the fixed or mobile bill type.

In that case, the advertising bills can be presented in turns facing at least one of the two windows 7.

The posts and crosspieces 3, 4 of the frame can be made of—without being limited to—structural straight channel sections. Through their intrados, these sections are oriented toward the center of the board. In other terms, the concave side of each post or crosspiece is turned toward the inside of the board 1. The posts and crosspieces can also consist of square or rectangular straight tubular sections.

In accordance with the invention, the billboard 1 is equipped with an odor diffuser 10 associated with a diffusing element 11 capable of diffusing outside the board 1, through an opening 1*a* in the latter, an odoriferous stream generated by the odor diffuser 10 at a proper rate.

In a preferred, not limiting, design, the opening 1*a* consists of a boring made in one of the side or base wings of one of the posts or crosspieces. If one of the posts or crosspieces of the board is already provided with an opening of the above-mentioned type, the diffusing element 11 will be positioned facing the latter, thus avoiding having to do boring work on that board.

On the attached figures, the diffusing element 11 is arranged in the volume defined by the lower crosspiece 3 and the opening 1*a* is made in the basal wing of this crosspiece. This configuration offers the advantage of making the opening 1*a* visible, but this opening can be made in one of the wings of one of the two posts 3 and the diffusing element housed in this post. This will be especially the case when the internal volumes of the upper and lower crosspieces are occupied by bill scrolling mechanisms.

The diffusing element 11 consists of a body comprising a diffusion chamber 110 that receives the odoriferous stream from the odor diffuser 10. This chamber has a first opening 111 placed in communication relation with the opening 1*a* in the board. Thus, this opening can be placed directly facing the opening 1*a* in the board, but according to a second embodiment, the opening 111 is in tight communication relation with a line that is in communication relation with the opening 1*a* in the board. Thus in the case where the posts and crosspieces of the board each consist of a tubular component, the line ensuring communication between the opening 111 and the opening 1*a* will be housed for the major part in the corresponding post. In this figure case, the opening 1*a* will be made for example at the lower end of the post. At a distance from the opening 1*a*, the post will be provided with a through-boring into which the diffusing element can be partly inserted so as to be connected in the post through its 111 to the above-mentioned line. A diffusing element external to the post can also be provided for; in that figure case, the above-mentioned line can be inserted into the post through-bore to be connected to the opening 111.

According to a preferred embodiment, the diffusing element 11 has a second opening 112 facing the board internal volume into which a fan 113 is placed to draw an air flow from the board internal volume to the chamber 110.

The odor diffuser 10 can be installed in the diffusion chamber 110 of the diffusing element and consist in this case of a substrate impregnated with a volatile odoriferous product that can come in the form of a gel or liquid, or of a container containing odoriferous products that can come in the form of crystals, a gel, a liquid or else.

In a preferred design, the odor diffuser 10 is external to the diffusion chamber 110 of the diffusing element and has a mixing head 13 capable of ensuring the mixing of a carrier gas with a concentrated odoriferous fluid in a suitable container 12. This mixing head 13 comprises an outlet port 135 through which the odoriferous stream achieved is delivered, which stream is driven toward the diffusing element 11, to then be driven to the outside of the board 1.

Under this odor diffuser embodiment, the diffusing element 11 comprises an inlet 114 of the odoriferous stream into the chamber 110, in communication relation with outlet 135 on the mixing head 13. This inlet 114 is materialized by a manifold entering the diffusion chamber 110.

In a preferred design, the first 111 and second 112 openings of the diffusion chamber 110 of diffusing element 11 are facing each other, and the inlet 114 of the odoriferous stream into said chamber is oblique or perpendicular to a geometric axis secant with the first and second opening, said opening being oriented toward the first opening.

This arrangement creates a Venturi effect in the diffusion chamber facilitating the introduction into said chamber of the odoriferous mixture produced by the mixing and fractioning head 13. In other terms, this odoriferous mixture is drawn into the diffusion chamber.

The diffusing element 11 around its first opening 111 can be equipped with a soft gasket through which it is attached to the lower crosspiece 4.

The odor diffuser 10 and the diffusing element 11 are lateral to the window 7 and are masked by the marginal zone 7*a* bordering the window 7. Thus, it is possible to avoid the formation of shadows on the billboard 8, shadows that can affect the esthetics of the bill on one hand and blur or alter the advertising message on the other hand. The odor diffuser 10 and the diffusing element 11 can be fully or partially housed inside the volume of at least one of the posts or crosspieces of the frame.

The odor diffuser 10 can be divided into several functional modules for better back integration of the marginal zone 7*a* bordering window 7, for example in the volume of one post 3 or crosspiece 4 on frame 2. These various modules can be attached through gluing or through adhesion-type removable fastening systems. It is thus possible to avoid any machining work on the posts or crosspieces.

Under a preferred embodiment, the odor diffuser 10 is basically divided into two separate functional modules that can be placed apart from each other. For example, the first of these modules will be placed in the volume defined by the lower crosspiece 4 while the second one will be placed in the volume defined by one of the two posts 3.

The first module consists of a control and command unit for the odor diffuser and of a compressor operated by a low power electric motor. This unit and the compressor electric motor are electrically connected to the lighting device power supply. The compressor is designed to deliver a carrier gas flow on its outlet manifold, said manifold being connected through a suitable line 14 to the mixing head 13. In a preferred design, the carrier gas is compressed air.

The control and command unit as well as the air compressor are housed in one single parallelepiped-shaped case of dimensions suitable to those of the crosspiece or post internal volume that receives it so as to be fully housed inside the volume of said post or crosspiece. In a preferred design, this case will be attached through gluing to said crosspiece.

The second module consists of the container 12 and the mixing head 13. The mixing head 13 comprises a head body into which a mixing chamber 130 is formed, a first conduit 131 in communication relation on one hand with the mixing chamber 130 and on the other hand with the internal volume of the container 12, a second conduit 132 in communication relation with the mixing chamber 130 on one hand and with a socket fitting end 133 on the other hand made horizontally into said head so as to end onto the lateral face of the head body, said second conduit 132 being designed to receive a stream of carrier compressed gas and a third conduit 134 in communication relation on one hand in the mixing chamber 130 and on the other hand with an outlet port 135 made in the upper face of the head body, said third conduit 134 and said outlet port 135 designed to carry outside of head 13 the mixture of carrier gas and odoriferous fluid.

In a preferred non-limiting design, the odoriferous fluid is drawn into the mixing chamber 130 by the Venturi effect, said effect being created by the flow of carrier gas through the mixing chamber.

The first conduit 131 is preferably connected in a tight manner to a line 131*a* feeding into the container 12. The socket end 133 receives in a removable manner a spigot end 15. This spigot end is mounted at the end of line 14, said line being connected to the compressor outlet manifold. The outlet port 135 is connected through line 16 to the diffusing element 11, more specifically at inlet 114 of the diffusing element 11.

The fluid contained in the container can be an odoriferous gas, but according to the preferred embodiment, the odoriferous fluid is a liquid and the mixing head 13 in the mixing chamber 130 also ensures the fractioning of the liquid into fine particles.

In a preferred design, the mixing and fractioning head 13 produces a nebulisate and, in that case, the odor diffuser is a nebulizer. The mixture delivered by the diffusing element will consequently be a nebulisate. It should be reminded that a nebulisate is made of particles of a size smaller than one micron. The advantages of producing a nebulisate are many. On one hand, the stream delivered by the diffusing element is visually imperceptible, but in addition for an equal quantity of liquid, a nebulisate contains a much higher number of particles than any other form of production of an odoriferous cloud, atomized or other, which permits to achieve an enhanced olfactory effect. Another advantage to produce a nebulisate, i.e., a cloud made of very fine particles, resides in the fact that contrary to a stream comprising large particles, the risk of pollution through deposit, both inside and outside the board, becomes inexistent due to the electrostatic charge of the particles and their rapid evaporation into the atmosphere because of their exit velocity. Should there exist a risk of presence of large particles in the odoriferous stream yielded by the head 13 of the odor diffuser 10, the diffusing element 11 does not have a fan 113 and is made of a body comprising a tight diffusion chamber receiving the odoriferous stream of the odor diffuser, said chamber having an outlet opening in communication relation with the opening 1*a* on the board and an inlet of the odoriferous stream in communication relation with said diffuser. This diffusion chamber acts as a relief chamber so that the large particles that the odoriferous stream might carry deposit on the latter's walls.

According to the preferred embodiment, the head 13 is attached on the rim of container 12, in a removable or non-removable manner.

The container 12 and head 13 are appropriately mounted in a support 17 attached in a removable manner in one of the board posts. This support ensures that the container and head are held vertically.

As one can see, this support 17 comprises a front plane vertical wing 170 bordered by two lateral vertical wings 171 running parallel to each other behind the front wing 170. The container 12 and the mixing head 13 are mounted in front of the front wing facing the latter. The front wing 170 is provided with a through-bore in which the spigot end 15 is fixed, the latter running horizontally through said wall. Behind the wall, the spigot end 15 is connected to the line 14. The head 13 through socket end 133 fits onto spigot end 14.

In addition, the support 17 is equipped with a vertical fitting end 18 at the outlet port 135 on head 13, said end 18 being connected to line 16. In a preferred design, this end 18 connects to the port through simple socketing, which facilitates the installation or removal of the head assembly 13 and container 12 on support 17.

In a preferred design, the fitting end 18 is borne in a floating manner by the support 17 and is applied against the outlet port 135 of the mixing head 13 through an elastic component 19 mounted in a compressive manner between the support 17 and said end 18. Because of the thrust action exercised by the elastic component 19, the end 18 remains in place in the outlet port 135 without any risk of nebulisate leak. In order to enhance tightness further at that level, an elastically deformable o-ring can be placed in a counterbore of the outlet port 135 and the fitting end 18, through the action of the spring 19, will be applied against this elastic gasket. The fact that the fitting end 18 is borne in a floating manner by the support 17 makes it possible to take up the positioning defects of the outlet port 35 of head 13 in relation to said end 18.

Under the preferred embodiment, the fitting end 18, through a cylindrical section of its body, limited by an upper shoulder 181 and a lower shoulder 182, is inserted with clearance into a boring made in an horizontal wing 172 of support 17, the working clearance giving to said end 18 a limited latitude of axial displacement and pivoting, the mixing head 13 and container 12 being positioned under said wing 172, the latter extending toward the front of frontal wing 170.

The elastic component 19 is a spiral spring arranged around the cylindrical section of the body of end 18, and mounted in a compressive manner between the horizontal wing 172 of support 17 and the lower shoulder 182 of end 18.

In a preferred design, a thrust 20 is provided, that is attached to the horizontal wing 172 of support 17, protruding downward, under which the upper face of the head 13, said thrust 20 being designed to limit the pivoting movement around the spigot end 15 of the head 13 and container 12 in a direction corresponding to the angular distance of the port 135 in relation to the end 18, the opposite pivoting movement being against the end 18.

This arrangement ensures an angular blocking of the container and head assembly in the support while allowing for a low amplitude pivoting movement in either direction limited to a few degrees in order to facilitate the installation or removal of said assembly head and container assembly from its support 17.

The support 17 is positioned in the volume defined by the corresponding post so that its lateral wings 171 are parallel to the lateral wings of this post, and oriented toward the basal wing of the latter. The container 12 and head 13 are turned toward the opening of this post to be readily accessible.

In the support 17, the first module together with the diffusing element 11 can be mounted above the second module. Thus a one-piece assembly is formed that will be placed vertically in one of the frame crosspieces.

Support 17 can be provided with a removable adhesion-type attachment system 21 in the corresponding post 3 of frame 2 for board 1. This attachment system works together with at least one of the lateral wings of the post and consists of a clamping pad 22 mounted at the end of an operating device 23. Through action on this device, the clamping pad is applied under pressure against one of the lateral wings to achieve securement or is kept apart. This operating device 23 comprises at least one arm 231 elastically flexible at the distal end of which the clamping pad 22 is placed, and a screw 232 and nut 233 type mechanism onto which the nut 233 is attached in a rigid manner at the proximal end of the arm 232 and onto which the screw 232 is arranged vertically, is inserted into a through-boring made in an upper horizontal wing 173 of the support, said screw 232 being blocked in translation and free in rotation in relation to said support 17 and said arm 231 running in an oblique manner in relation to the screw 232 and coming to rest against a fixed radial thrust 24, so that by operating the screw 232 the obliquity of the arm is modified through elastic deformation of said arm, and said arms turns and slides on the thrust 24, which translates into a distancing or closing movement of the pad 22 in relation to the screw.

In a preferred design, the pad 22 shall be made of a fold-over of the arm 231.

The arm 231 is inserted through its distal area into a opening 241 made in a lateral vertical wing 171 of the support 17, one of the upper or lower lip of said opening depending on whether the proximal end of the arm 231 is lower or higher than the distal end, making up the fixed radial thrust 24.

Under a preferred embodiment, the operating device 23 comprises two opposite arms 231 each provided with a clamping pad 22, and inserted into two openings 241 made in the vertical lateral wings 171 of the support 17. The attachment system 21 works together with the post two lateral wings.

Preferably to improve the quality of the attachment, the operating device 23 comprises two pairs of opposite arms 231, i.e., an upper pair of arms and a lower pair of arms, mechanically jointed to each other through a tie bar 25 and a stress transmission link. A upper pair of openings and a lower pair of openings 241 will be provided in the lateral wings 171 The attachment of the support 17 in the respective post 3 will be made with four upper and lower points.

To facilitate the removal of the head 13 and container 12 assembly, an operating handle 26 will be added to this assembly. This operating handle is pivoted to a plate 27 inserted between the head 13 and the container 12 and comprises beyond its articulations two arm shapes 28 capable of having a thrust action against the front wall 170 of the support 17 when it is tilted upward.

It is understood that this invention can accommodate any fixtures and alternatives from the field of equivalent techniques without thereby going outside the spirit of this invention.

I claim:

1. Billboard to display an advertising message to be seen simultaneously by several people and to diffuse an odor, said board comprising:

a frame comprised of two vertical posts assembled with two upper and lower horizontal posts, defining a parallelepiped volume in which at least one of two opposite large faces comprises a quadrangular display window bordered by a perimeter marginal zone of a board face and in which volume an advertising message display assembly is arranged facing the window; and at least one odor diffuser generating an odoriferous stream, installed inside the volume of the frame and associated to an odor diffusing element inside the volume of the frame, said element being comprised of a diffusion chamber receiving the odoriferous stream, said chamber being in communication relation with an opening thereof, ending outside, to diffuse outside the internal volume, an odoriferous stream generated by the diffuser;

wherein said odor diffuser has a mixing head ensuring the mixing of a carrier gas with an odoriferous fluid contained in a suitable container, said mixing head being in communication relation with the diffusion chamber of the diffusing element and having an outlet through which the odoriferous stream obtained is delivered, which is drawn to the diffusing element, to then be driven to the outside of the board.

2. Billboard according to claim 1, wherein said diffusing element is comprised of a body comprising a diffusion chamber receiving the odoriferous stream and the diffusing element comprises an inlet of the odoriferous stream into said chamber, connected through a line to the outlet of the head on the odor diffuser.

3. Billboard according to claim 2, wherein the first and second openings of the diffusion chamber of diffusing element are facing each other, and that the inlet of the odoriferous stream into said chamber is oblique or perpendicular to a geometric axis secant with the first and second openings, said inlet being oriented toward the first opening.

4. Billboard according to claim 1, wherein the odoriferous fluid is comprised of an odoriferous gas, the odor diffuser then comprising an odoriferous compressed gas container, connected through a manifold to the mixing head.

5. Billboard according to claim 1, wherein the odoriferous fluid is comprised of a liquid, the odor diffuser comprising then a container of odoriferous liquid connected to the mixing head, said head also ensuring the fractioning of the liquid into fine particles.

6. Billboard according to claim 5, wherein the diffused mixture is comprised of a nebulisate, and wherein the odor diffuser is a nebulizer.

7. Billboard according to claim 1, wherein the odor diffuser is divided into two separate modules with the first one being comprised of an odor diffuser operation control and command unit and an electric motor driven compressor and the second one consisting of the container and mixing head.

8. Billboard according to claim 1, wherein the mixing head is attached onto a rim of the container.

9. Billboard according to claim 1, wherein the container and the mixing head are mounted in a support attached in a removable manner into one of the posts of the frame of the board.

10. Billboard according to claim 9, wherein the support bears an horizontal spigot end to work together through socketing with the socket end of the mixing head, said spigot end being connected through a line to the compressed gas outlet of a compressor comprised in the odor diffuser.

11. Billboard according to claim 9, wherein the support bears a vertical fitting end connecting the outlet port on the mixing head, said fitting end being connected through a line to the diffusing element.

12. Billboard according to claim 11, wherein the fitting end is borne in a floating manner by the support and is applied against the outlet port on the mixing head through an elastic component.

13. Billboard according to claim 12, wherein the fitting end, through a cylindrical section of its body, limited by an upper shoulder and a lower shoulder, is inserted with clearance into a boring made in an horizontal wing of support, the working clearance giving to said end a limited latitude of axial displacement and pivoting, the mixing head and container being positioned under said wing.

14. Billboard according to claim 13, wherein the elastic component is comprised of a spiral spring arranged around the cylindrical section of the body of the fitting end, and mounted in a compressive manner between the horizontal wing of support and the lower shoulder of the fitting end.

15. Billboard according to claim 12, further comprising a thrust attached to the horizontal wing of support, protruding downward, under which the upper face of the mixing head is located, said thrust limiting pivoting movement around the spigot end of the mixing head and container in a direction corresponding to the angular distance of the port in relation to the end, the opposite pivoting movement being against the fitting end.

16. Billboard according to claim 9, wherein the support is comprised of an adhesion-type removable attachment system in the corresponding post of frame for board, this attachment system working together with at least one of the lateral wings of this post.

17. Billboard according to claim 16, wherein the adhesion-type removable attachment system comprises a clamping pad, mounted at the end of an operating device.

18. Billboard according to claim 17, wherein the operating device comprises at least one arm elastically flexible at the distal end of which the clamping pad is placed, and a screw and nut type mechanism onto which the nut is attached in a rigid manner at the proximal end of the arm and onto which the screw is arranged vertically, is inserted into a through-boring made in an upper horizontal wing of the support, said screw being blocked in translation and free in rotation in relation to said support and said arm running in an oblique manner in relation to the screw and coming to rest against a fixed radial thrust, so that by operating the screw the obliquity of the arm is modified through elastic deformation of said arm, and said arm turns and slides on the thrust, which translates into a distancing or closing movement of the pad in relation to the screw.

19. Billboard according to claim 18, wherein the arm is inserted through its distal area into an opening made in a lateral vertical wing of the support, one of the upper or lower lip of said opening depending on whether the proximal end of the arm is lower or higher than the distal end, making up the fixed radial thrust.

20. Billboard according to claim 19, wherein the operating device comprises two opposite arms having each a clamping pad, which fit into two openings made in the vertical lateral wings of the support.

21. Billboard according to claim 20, wherein the operating device comprises two pairs of opposite arms, an upper pair of arms and a lower pair of arms, mechanically linked to each other through a tie bar and a stress transmission link.

22. Billboard according to claim 1, wherein said diffusing element is comprised of a body comprising a diffusion chamber receiving the odoriferous stream and the odor diffuser is installed in the diffusion chamber of the diffusing element.

23. Billboard according to claim 22, wherein the odor diffuser comprises a substrate impregnated with a volatile odoriferous product that can come in the form of a gel or liquid.

24. Billboard according to claim 22, wherein the odor diffuser is comprised of a container containing odoriferous products that can come in the form of crystals, gel, liquid or gas.

25. Billboard according to claim 1, wherein the odor diffuser and the diffusing element are lateral to the window and are masked by the perimeter marginal zone of said window.

* * * * *